United States Patent [19]

Barbaglia

[11] Patent Number: 4,782,778

[45] Date of Patent: Nov. 8, 1988

[54] INFLATION VALVE DEVICE

[76] Inventor: Michael J. Barbaglia, 8607 Virgil, Affton, Mo. 63123

[21] Appl. No.: 79,934

[22] Filed: Jul. 31, 1987

[51] Int. Cl.[4] ..... B63C 1/02

[52] U.S. Cl. ..... 114/52; 114/45

[58] Field of Search ..... 114/258, 263, 44, 45, 114/52, 53, 54; 141/38; 152/416–417; 137/883

[56] References Cited

U.S. PATENT DOCUMENTS

| | | | |
|---|---|---|---|
| 2,989,999 | 6/1961 | Holbrook et al. | 152/416 |
| 3,750,704 | 9/1973 | Burke et al. | 137/625.47 |
| 4,072,119 | 2/1978 | Williams | 114/45 |
| 4,387,931 | 6/1983 | Bland | 303/1 |
| 4,421,151 | 12/1983 | Stumpe | 152/417 |
| 4,509,446 | 4/1985 | Sutton | 114/45 |
| 4,641,698 | 2/1987 | Bitonti | 152/416 |

*Primary Examiner*—Sherman D. Basinger
*Assistant Examiner*—Jes/ s D. Sotelo
*Attorney, Agent, or Firm*—Senniger, Powers, Leavitt and Roedel

[57] ABSTRACT

An inflation valve device which comprises a tee, a screwed bushing, a valve, and a hose having a hose adaptor. The inflation valve device is inserted in the hose of a pontoon type boat lift. The inflation valve device is used to release air stored in the pontoons to inflate various inflatable devices.

20 Claims, 1 Drawing Sheet

INFLATION VALVE DEVICE

BACKGROUND AND SUMMARY OF THE INVENTION

This invention relates to an inflation valve device and more particularly to a valve adapted for use in inflating inflatable objects such as rafts or toys or the like.

Boating is a very enjoyable and popular activity. To help enhance the boating experience, boaters bring along with them a vast array of inflatable devices such as rafts, inner tubes, beach balls and other toys or games. Inflating these devices is usually accomplished by the user blowing into the device to inflate it. This method has proven to be both time consuming and inconvenient. Also, some inflatable devices are very difficult to inflate.

In order to solve this problem, the inventor herein has noticed that many boat owners have pontoon type boat lifts in their docks which can be inflated to raise their boat out of the water when not in use. A typical inflatable pontoon boat lift is shown in U.S. Pat. No. 4,072,119, entitled "VERTICAL RISING BOAT LIFT", issued Feb. 7, 1978. To inflate the boat lift an air compressor is activated and air is forced into the pontoons through a hose. The pontoons become buoyant and raise the boat lift. When the boat lift reaches its desired height the air compressor is deactivated and a valve is closed to contain the air in the pontoons. To deflate the boat lift, the air trapped in the pontoons is released allowing buoyancy to be lost and the boat lift is lowered into the water.

In order to solve the previously mentioned inflation problem, the inventor herein has succeeded in developing an inflation valve which is inserted into the hose of a pontoon type boat lift. With the present invention, the user takes advantage of the air trapped in the pontoons to inflate various inflatable devices.

The inflation valve device of the present invention generally comprises a tee inserted in the hose of a pontoon type boat lift, a plastic screw bushing screwed in the tee, a valve threaded in the bushing, and a hose having a hose adaptor inserted in the valve. To install this device the hose leading to the pontoons is cut and the tee is inserted in the hose. A pair of hose clamps are placed around the hose at the points were the tee and the hose meet. The hose clamps are tightened to secure the hose to the ends of the tee insuring that no air escapes from the hose.

In operation, the pontoons of the boat lift are initially filled with air. The user inserts the hose of the invention in the device to be inflated and the inflation valve is opened. Air from the pontoons passes through the tee, valve, and hose into the device thereby inflating it. Once the device has been completely inflated the valve is closed to save the air in the pontoons should any other devices need to be blown up.

The inflation valve device of this invention provides the user with a convenient and enjoyable way to inflate various devices. The inflation valve device also eliminates the disadvantages that are associated with a user manually inflating inflatable devices.

DETAILED DESCRIPTION OF THE PREFERRED EMBODIMENT

The inflation valve device of this invention is indicated generally as 10 in the figures.

Figure 1:
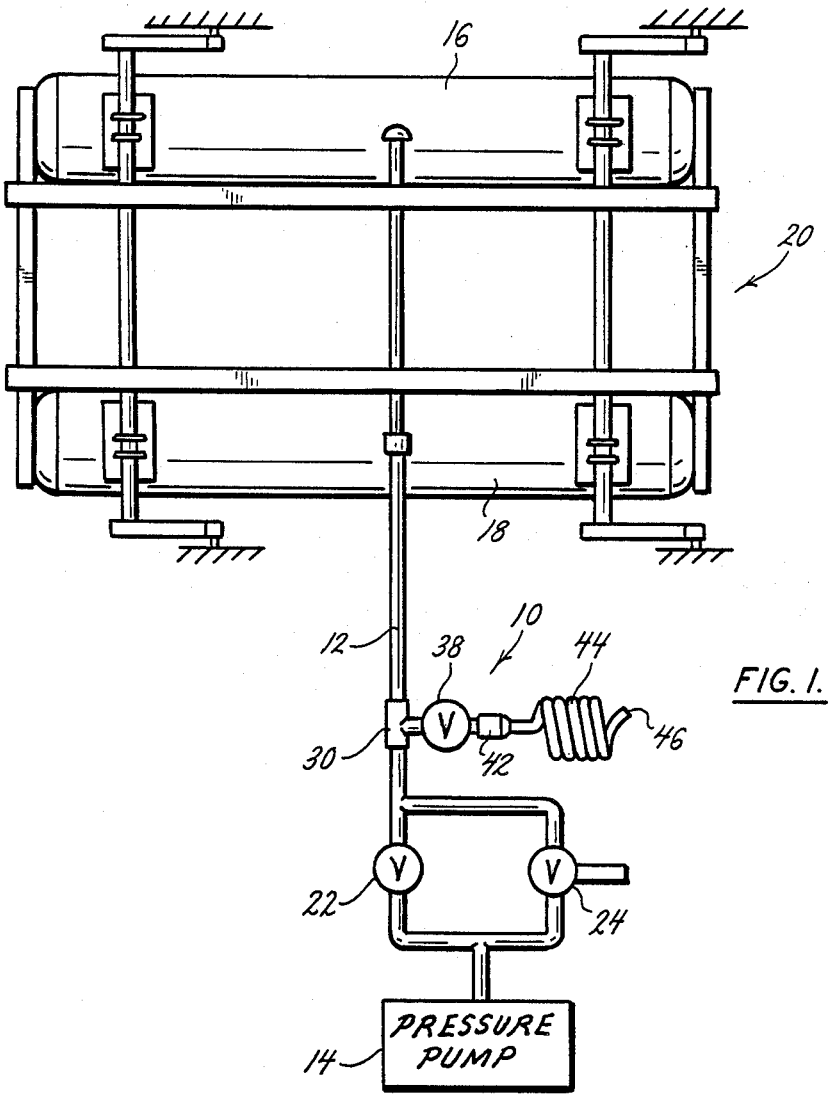
FIG. 1 is a schematic view of the inflation valve device of the present invention installed in the hose of a pontoon type boat lift.

As illustrated in FIG. 1, the inflation valve device 10 is inserted in the hose 12 of a pontoon type boat lift. The hose 12 connects a pressure pump 14 to a pair of pontoons 16 and 18. To raise and lower a boat a frame assembly indicated generally as 20 is utilized. The frame assembly 20 is not described in detail because its use is well known in the art of boat lifts.

Connected to the pressure pump 14 are a pair of valves. The first valve is the inflate valve 22 and the second valve is the deflate valve 24. Before the pressure pump 14 is activated to raise the boat lift both the inflate valve 22 and the deflate valve 24 are closed and the pontoons 16 and 18 are filled with water. Upon activation of the pressure pump the inflate valve 22 opens allowing air to flow through the hose 12 to fill up the pontoons 16 and 18. Any water in the pontoons 16 and 18 is forced out through openings (not shown) and the pontoons 16 and 18 gain bouyancy thereby raising the boat lift. When the boat lift has reached its desired height the pressure pump is turned off and inflate valve 22 closes trapping air in the pontoons 16 and 18. To lower the boat lift into the water, the deflate valve 24 is opened to release the air from the pontoons 16 and 18 and water enters the pontoons 16 and 18 through openings (not shown). The deflate valve 24 in this case is a manual 3-way valve which allows the user to operate the boat lift manually in case the inflate valve 22 fails.

Figure 2:
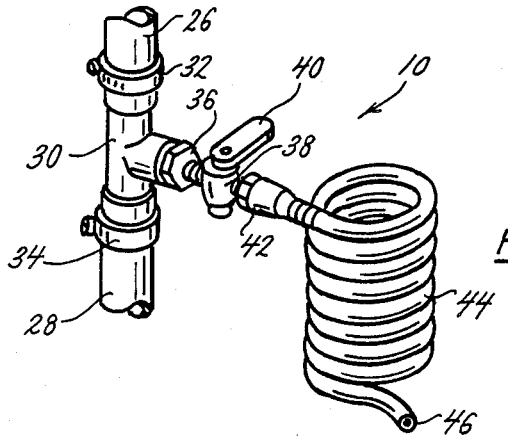
FIG. 2 is a perspective view of some of the main components illustrated in FIG. 1.

FIG. 2 shows the main components of the present invention. The hose 12 of the boat lift has been cut to form a first hose section 26 and a second hose section 28. One end of a tee 30 has been inserted in the first hose section 26 and the other end of the tee 30 has been inserted in the second hose section 28. A pair of hose clamps 32 and 34 have been placed around the hose sections 26 and 28 to secure the hose sections 26 and 28 to the ends of the tee 30. Screwed in the third end of the tee 30 is a screw bushing 36 which in turn has a valve 38 threaded in the other end of the screw bushing 36. The valve 38 has a handle 40 for opening and closing the valve 38. Connected to the other end of the valve 38 is a hose adaptor 42 and a hose 44. The inventor has found that the tee 30 and screw bushing 36 preferably should be made of plastic, the hose 44 preferably should be made from PVC plastic hosing and preferably should also be self coiling, and that the valve 38 preferably should be made of brass.

In the typical situation, the user arrives at the boat dock with the boat on the boat lift and the boat lift in the up position. Since the pontoons 16 and 18 are filled with air and the user needs to blow up his inflatable devices before using them the user will employ the inflation valve device 10. The user inserts the end 46 of the hose 44 into the item to be inflated and moves the handle 40 in the open position. Once the valve 38 is opened air from the pontoons 16 and 18 flows through the hose 12 and the valve device 10 into the item thereby inflating it. When inflation of that item is completed the user closes the valve 38. The hose 44 is then inserted into the next item to be inflated and the process is continued until all the objects to be inflated have been blown up. When the inflation process has been completed and there is still air in the pontoons 16 and 18, the deflate valve 24 may be opened to release the remaining air. The deflate valve 24 is preferred to be used to deflate the pontoons 16 and 18 over the valve 38 because typically the valve 38 has a lower flow rate than the deflate valve 24 and it would take longer for the air to be released from the pontoons 16 and 18 if it were used. Once all the air has been emptied from the pontoons 16 and 18, the boat lift is lowered into the water and the boat is then launched for the boating trip.

To insure that the hose 44 fits into the device to be inflated the user may have to insert an inflation needle (not shown) into the end 46 of the hose 44. This will funnel all the air into the device to be inflated and no air will escape into the atmosphere.

There are various changes and modifications which may be made to this invention as would be apparent to those skilled in the art. However, these changes or modifications are included in the teaching of the disclosure, and it is intended that the invention be limited only by the scope of the claims appended hereto.

What is claimed is:

1. An inflation valve device for releasing air stored in at least one inflatable pontoon of a pontoon type boat lift to inflate various inflatable devices comprising:

a tee having three ends, two of the ends connected to a hose of the pontoon boat lift;

a screw bushing having two ends, one end being screwed into the third end of the tee;

a valve having two ends, one end being threaded into the other end of the screw bushing; and a second hose having a hose adaptor at one end, the hose adaptor being inserted into the other end of the valve, the other end of the second hose being for inserting into the inflatable devices.

2. The device of claim 1 wherein the tee comprises a plastic material.

3. The device of claim 1 wherein the screw bushing comprises a plastic material.

4. The device of claim 1 wherein the valve comprises a brass material.

5. The device of claim 4 wherein the valve further comprises a handle for opening and closing the valve.

6. The device of claim 1 wherein the second hose comprises a plastic material.

7. The device of claim 6 wherein the plastic material is PVC.

8. The device of claim 7 wherein the second hose is self coiling.

9. In a boat lift for selectively raising and lowering a boat out of and into the water, the boat lift comprising at least one inflatable pontoon, a framework attached to and supported by the pontoon, valve means to control air flow into and out of the pontoon, means to generate a supply of pressurized air for inflating the pontoon, and a hose connected from the means to generate a supply of pressurized air to the valve means and from the valve means to the pontoon, the improvement comprising means for releasing the air stored in the pontoon for inflating various inflatable devices.

10. The device of claim 9 wherein the means for releasing the air stored in the pontoon comprises:

a tee having three ends, two of the ends connected to the hose;

a screw bushing having two ends, one end being screwed into the third end of the tee;

a valve having two ends, one end being threaded into the other end of the screw bushing; and a second hose having a hose adaptor at one end, the hose adaptor being inserted into the other end of the valve, the other end of the second hose being for inserting into the inflatable device.

11. The device of claim 10 wherein the tee comprises a plastic material.

12. The device of claim 10 wherein the screw bushing comprises a plastic material.

13. The device of claim 10 wherein the valve comprises a brass material.

14. The device of claim 13 wherein the valve further comprises a handle for opening and closing the valve.

15. The device of claim 10 wherein the second hose comprises a plastic material.

16. The device of claim 15 wherein the plastic material is PVC.

17. The device of claim 16 wherein the second hose is self coiling.

18. A method of releasing the air stored in an inflatable pontoon boat lift for inflating various inflatable devices, the method comprising:

inserting a tee into a hose of the boat lift;

screwing a screw bushing into one end of the tee;

threading a valve into the other end of the screw bushing;

attaching a second hose to the other end of the valve;

inserting the inflatable device into the other end of the second hose; and opening the valve to direct the flow of the air from the pontoon into the inflatable device.

19. The method of claim 18 wherein the tee inserting step is preceded by cutting the hose of the boat lift.

20. The method of claim 18 wherein the attaching step is preceded by attaching a hose adapter to the end of the second hose which is attached to the valve.

* * * * *